US006611604B1

(12) United States Patent
Irby et al.

(10) Patent No.: US 6,611,604 B1
(45) Date of Patent: Aug. 26, 2003

(54) ULTRA LOW FREQUENCY TRANSDUCER AND LOUD SPEAKER COMPRISING SAME

(75) Inventors: Steven M. Irby, Stillwater, OK (US); William O. Doering, Stillwater, OK (US)

(73) Assignee: Stillwater Designs & Audio, Inc., Stillwater, OK (US)

( * ) Notice: Subject to any disclaimer, the term of this patent is extended or adjusted under 35 U.S.C. 154(b) by 0 days.

(21) Appl. No.: 09/610,600

(22) Filed: Jul. 5, 2000

Related U.S. Application Data

(60) Provisional application No. 60/160,959, filed on Oct. 22, 1999.

(51) Int. Cl.[7] ..... H04R 25/00

(52) U.S. Cl. ..... 381/398; 381/396; 381/423; 181/171

(58) Field of Search ..... 381/386, 398, 381/423, 430, FOR 162, 432, 396; 181/171, 172

(56) References Cited

U.S. PATENT DOCUMENTS

| | | | | |
|---|---|---|---|---|
| 1,771,318 A | | 7/1930 | Schlenker | |
| 2,002,190 A | | 5/1935 | Round | |
| 2,020,705 A | | 11/1935 | Stenger | |
| 2,439,665 A | | 4/1948 | Marquis | |
| 2,442,791 A | | 6/1948 | Wente | |
| 2,998,496 A | * | 8/1961 | Hassan | 381/416 |
| 3,026,958 A | | 3/1962 | Haerther, Jr. | |
| 3,045,776 A | * | 7/1962 | Igarashi | 181/171 |
| 3,563,337 A | | 2/1971 | Kawamura et al. | |
| 3,983,337 A | | 9/1976 | Babb | |
| 4,257,325 A | | 3/1981 | Bertagni | |
| 4,284,167 A | | 8/1981 | Kozlow et al. | |
| 4,321,434 A | | 3/1982 | Irie | |
| 4,564,727 A | * | 1/1986 | Danley et al. | 381/117 |
| 4,897,877 A | * | 1/1990 | Tetztaff | 381/402 |
| 4,928,312 A | | 5/1990 | Hill | |
| 5,251,188 A | | 10/1993 | Parsons et al. | |
| 5,361,380 A | * | 11/1994 | You et al. | 381/349 |
| 5,371,805 A | | 12/1994 | Saiki et al. | |
| 5,418,337 A | | 5/1995 | Schreiber | |
| D371,367 S | | 7/1996 | Bittencourt | |
| 5,539,835 A | | 7/1996 | Bertagni et al. | |
| 5,566,242 A | * | 10/1996 | Hall | 381/430 |
| 5,608,810 A | * | 3/1997 | Hall | 381/430 |
| 5,693,917 A | | 12/1997 | Bertagni et al. | |
| 5,740,264 A | | 4/1998 | Kojima | |
| 6,026,929 A | | 2/2000 | Faaraone | |
| D442,945 S | | 5/2001 | Mahgerefteh | |
| D443,260 S | | 6/2001 | Jordan | |

FOREIGN PATENT DOCUMENTS

| | | |
|---|---|---|
| JP | 61-80998 | 4/1986 |

* cited by examiner

*Primary Examiner*—Huyen Le
(74) *Attorney, Agent, or Firm*—Mary M. Lee

(57) ABSTRACT

An ultra low frequency transducer or subwoofer for automotive speaker systems with a rectangular or square, concave diaphragm. The square periphery preferably is sized to be substantially coextensive with the front of the speaker housing or cabinet. In this way, air displacement in the subwoofer is maximized for a given size of enclosure, and thus so is the loudness of the speaker. The transducer typically includes a frame or basket with a square front for supporting the periphery of the diaphragm. The preferred diaphragm includes a convex surround with pleated corners. For increased durability, trusses are formed in the diaphragm.

70 Claims, 4 Drawing Sheets

ULTRA LOW FREQUENCY TRANSDUCER AND LOUD SPEAKER COMPRISING SAME

This application claims priority to U.S. provisional application Ser. No. 60/160,959, filed Oct. 22, 1999, entitled "Ultra Low Frequency Transducer," which is incorporated herein by reference.

FIELD OF THE INVENTION

The present invention relates to ultra low frequency transducers for use as subwoofers for automotive speaker systems.

SUMMARY OF THE INVENTION

The present invention is directed to an ultra low frequency transducer comprising a concave diaphragm supported by a basket for axial movement. The diaphragm has a rectangular periphery supported in the rectangular front of the basket. The transducer further includes a driver assembly supported by the basket and comprises a permanent magnet and a reciprocally supported voice coil linked to the diaphragm. The voice coil is connected to a signal source. In this way, the driver assembly is adapted to convert signals from the signal source into reciprocating axial motion of the diaphragm to produce ultra low frequency sounds.

The present invention further comprises a loud speaker comprising the above-described ultra low frequency transducer supported inside an enclosure. In this loud speaker, the enclosure has a rectangular opening and the rectangular periphery of the diaphragm is about the same size as the opening.

DETAILED DESCRIPTION OF THE PREFERRED EMBODIMENT

In automotive speakers, space is extremely limited. The need to minimize the size of the speaker is constantly at battle with the need to maximize sound and performance of the speakers. This is especially true in the case of subwoofers, where ultra low frequency sounds are produced.

Speaker loudness is a function of the volume of air displaced by movement of the diaphragm, which is in turn a function of the stroke or excursion of the diaphragm and its diameter. The lower range of the typical stereo speaker or woofer only operates down to about 40–80 Hz. However, with modem recording techniques, musical recordings generate much lower signals to as low as 20 Hz or below. There is a need for a subwoofer that can satisfactorily reproduce these ultra low range signals.

The present invention is directed to an ultra low frequency transducer, that is, a transducer capable of effectively reproducing only about the lowest two octaves of music, from about 20 Hz to about 80 Hz. The transducer of the present invention has a concave diaphragm (or cone) with a rectangular or square periphery. The rectangular shape maximizes the diaphragm area relative to the enclosure, which is also usually rectangular, and thus the air displacement in the speaker.

Figure 1:
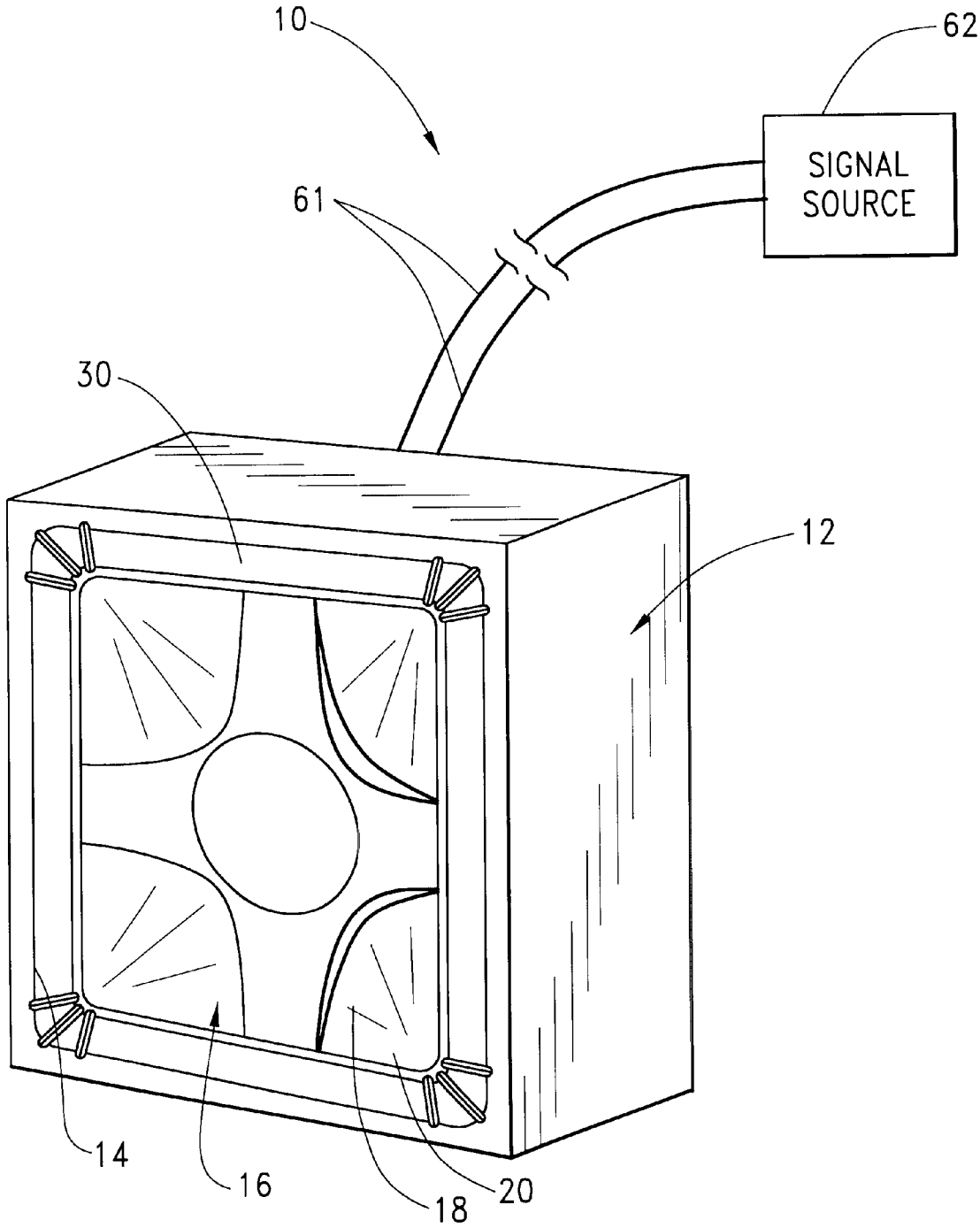
FIG. 1 is a right frontal perspective view of the loud speaker of the present invention.
Figure 2:
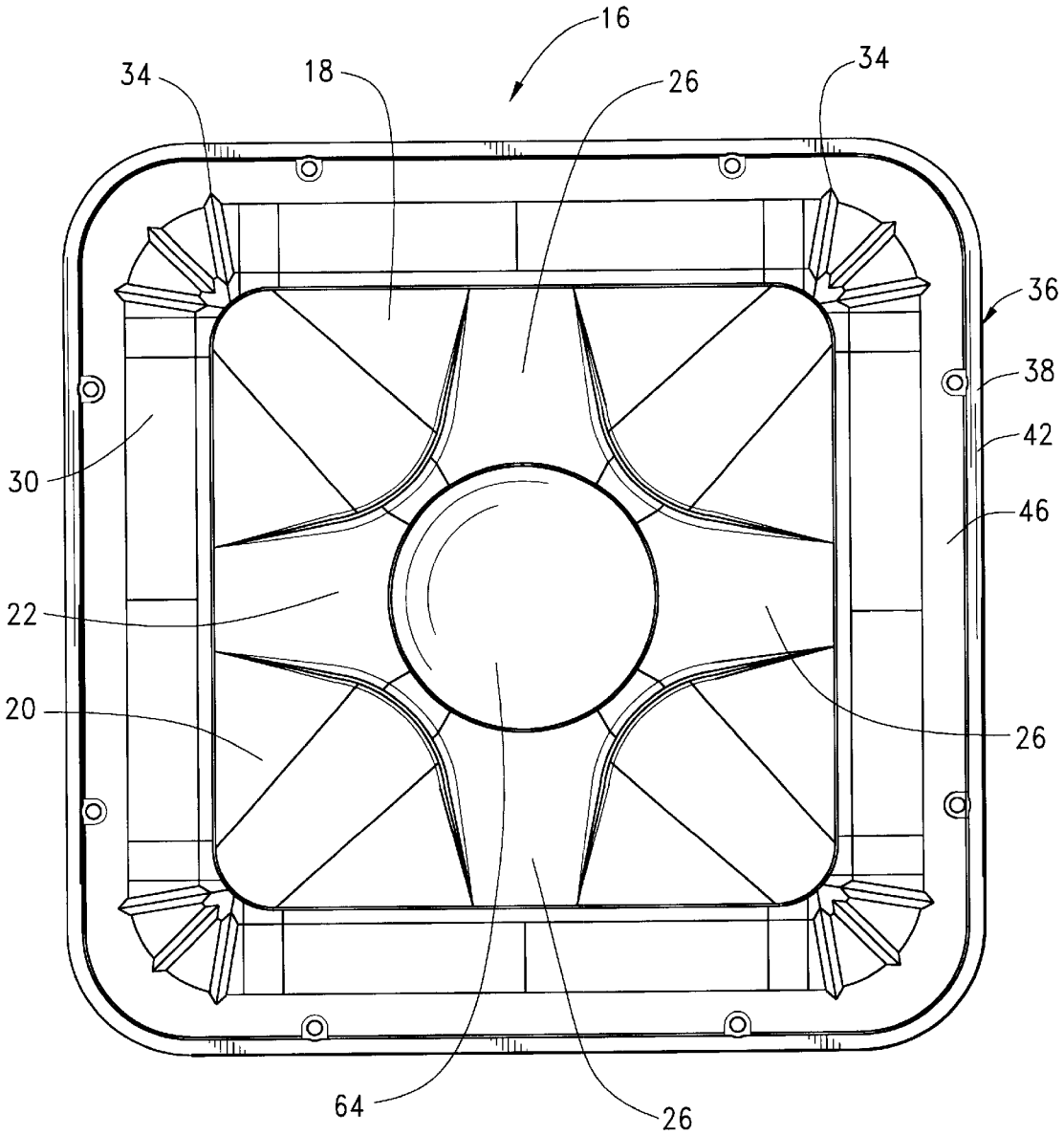
FIG. 2 is a front elevational view of the ultra low frequency transducer.

Turning now to the drawings in general and to FIG. 1 in particular, there is shown therein a loud speaker in accordance with the present invention and designated generally by the reference numeral 10. The speaker 10 comprises an enclosure 12 with a frontal opening 14. The enclosure houses a transducer 16 with a diaphragm 18 having a periphery 20 sized to be substantially coextensive with the opening 14. As best shown in FIG. 2, the frontal opening 14 of the enclosure preferably is rectangular and more preferably the opening is square. Similarly, the periphery 20 of the diaphragm 18 is rectangular and more preferably is square and is about the same size as the frontal opening 14. As used herein, "rectangular" means a parallelogram with a right angle, and square means a rectangle with four equal sides.

Figure 3:
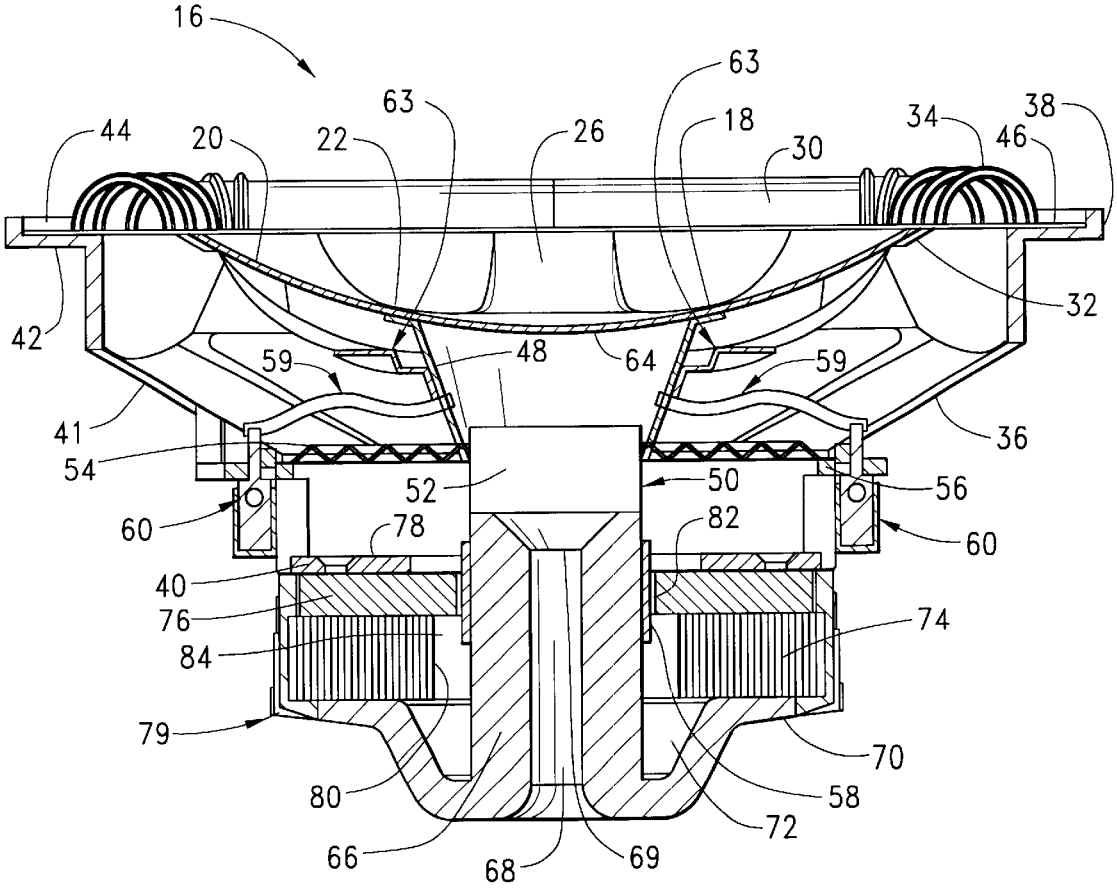
FIG. 3 is a longitudinal sectional view of the ultra low frequency transducer of the loud speaker of FIG. 1.
Figure 4:
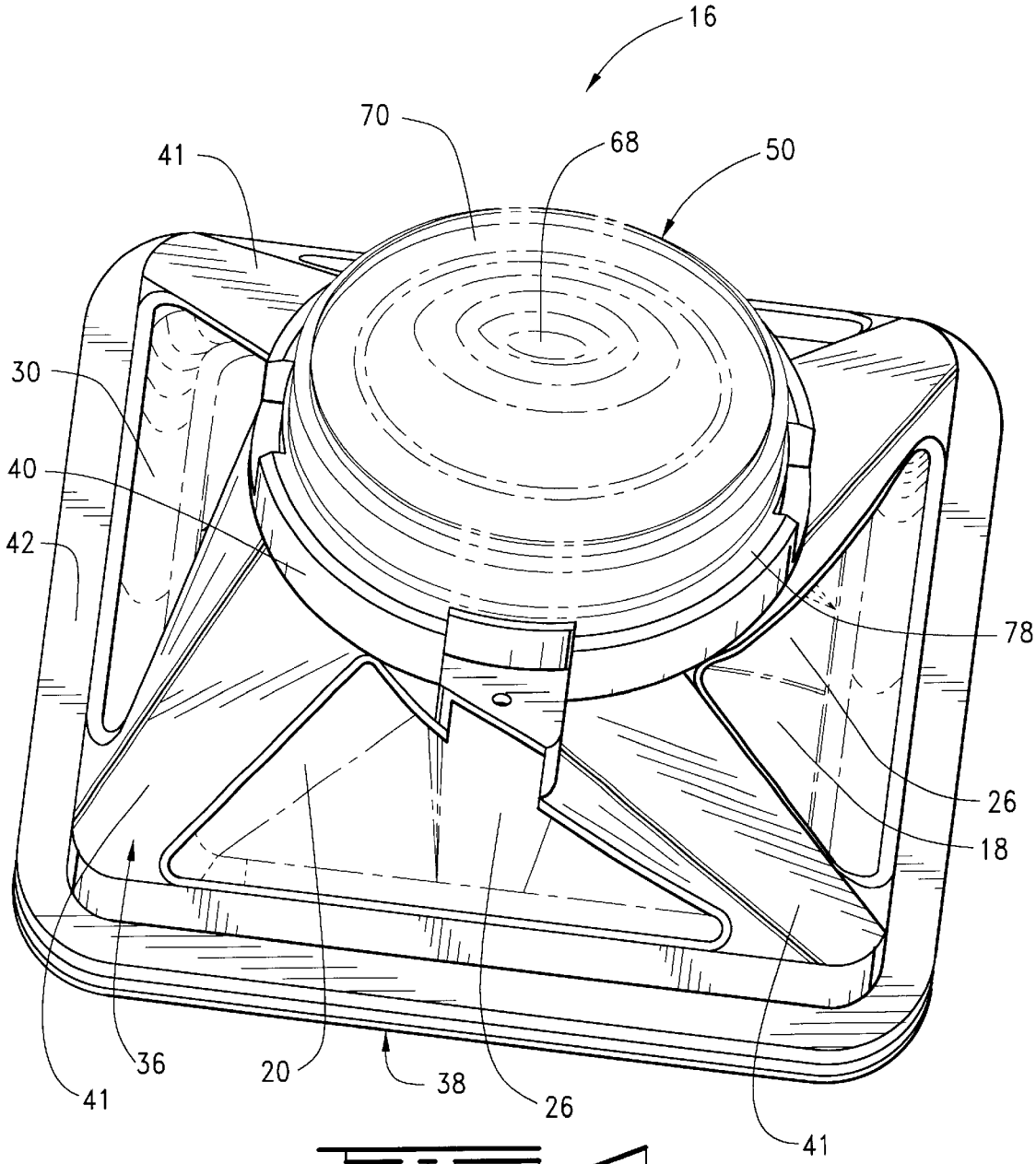
FIG. 4 is a rear perspective view of the basket of the ultra low frequency transducer.

With reference now also to FIGS. 3 and 4, the construction of the preferred transducer will be described. As indicated, and as best seen in FIG. 3, the diaphragm 18 is concave, that is, the inner aspect or body portion 22 is generally dome-shaped. As used herein, "concave" is relative to the front of the enclosure and denotes a shape in cross-section that has a depth. Thus, "concave" would include conical or frustoconical.

The diaphragm 18 preferably is made of a special talc-filled polypropylene material that is very stiff and highly internally damped. The internal damping controls standing waves on the diaphragm, while the stiffness suppresses flex during large excursions. The preferred diaphragm is resistant to pollution, sunlight and moisture.

The diaphragm in a subwoofer is subject to a great deal of stress because of the high excursion. For this purpose, the diaphragm 18 is formed with reinforcing trusses, one of which is designated by the reference numeral 26 (FIG. 2). Preferably, the trusses are contours formed into the diaphragm when it is made.

In the preferred embodiment, the diaphragm 18 includes a surround 30 extending around the periphery 20. The surround 30 conforms to the shape of the periphery of the diaphragm 18 and therefore also is rectangular. The ideal configuration of the surround 30 is convex in cross-section. As used herein, "convex" is relative to the front of the speaker. The surround 30 preferably is made of a flexible, but shape-sustaining material, and usually is not the same as the more rigid material used for the main body 22 of the diaphragm 18.

In the preferred embodiment, the diaphragm edge is stepped down to form a platform or flange 32 to which the surround is glued. The stepped down flange 32 adds to the rigidity of the diaphragm 18, and serves as a convenient point of attachment, usually by stitching, for the inner edge of the surround 30.

To improve the performance and durability of the surround 30, the corners are provided with one or more radially positioned ribs or pleats, one of which is designated by the reference numeral 34. While the pleats 34 shown are outwardly extending, the pleats alternately may be depending grooves. Further, the number, spacing, width, and cross-sectional shape of the pleats may be varied. The pleats allow the surround to collapse and expand uniformly as the diaphragm 18 reciprocates. This reduces distortion and buckling of the surround 30, particularly at the corners.

With continued reference to FIGS. 3 and 4, the transducer 16 comprises a frame or basket 36 that supports the components of the transducer. The basket 36 has a front 38 and a rear 40 connected by a plurality of struts 41 therebetween. The front 38 preferably is provided with a planar edge 42 having a recess 44 adapted to receive an outer flange 46 on the surround 30. In this way, the periphery 20 of the diaphragm 18, by means of the flange 46 on the surround 30, is supported on the front 38 of the basket 36. Preferably, the basket is made of die cast aluminum. The cast aluminum basket is more rigid than stamped steel.

More particularly, in a manner that will be described hereafter, the diaphragm 18 is thereby supported on the basket 36 for axial, reciprocal movement inside the enclosure 12. Though not shown herein, a gasket may be attached over the flange 46 of the surround 30 and under the front edge 42 of the basket 36. A preferred gasket material is Rubatex brand, which is composed of foam rubber, chopped and glued, to provide an excellent seal to many surfaces.

As best seen in FIG. 3, the center portion 48 of the diaphragm 18 preferably is frusto-conically shaped and extends inwardly. The diaphragm 18 is operatively associated with a suitable driver assembly 50, yet to be described, also supported by the basket 36. To that end, the open edge of the diaphragm center 48 is attached circumferentially to the closed end of a voice coil former 52 in a known manner. A Kapton brand voice coil former is preferred because it is lightweight, strong, and retains its shape at high temperatures.

While the surround 30 attached to the front 38 of the basket 36 is the upper support for the moving system, a spider 54 preferably provides the lower support. A progressive spider may be used to reduce stress on the glue joint at the former 52, and force it to the outer regions. The spider 54 also provides soft mechanical limiting and centering as it extends radially between the former 52 and adjacent annular section 56 of the basket 36.

A voice coil 58 is supported on the former 52 in a known manner. A longer voice coil 58 is desired as it gives the driver greater excursion capability to move more air and produce more low bass. A preferred coil for the present invention comprises a 4-layer round wire. The wire insulation and coil adhesives are designed to handle the heat associated with high power operation.

The coil 58 is attached by tinsel leads 59 which connect to terminals 60 supported on the annular section 56 of the basket 36. The external leads 61 connect the terminals 60 to a signal source 61, such as the radio or disk player in an automobile (see FIG. 1).

As the tinsel leads 59 must absorb the abuse of motion as well as transfer large currents to the voice coil 58, it will be desirable to use two braided leads. An annular cone brace 63 may be included to provide additional support for the cone, which must also endure repetitive wide excursions.

Preferably the transducer 16 comprises an inverted structural dome or dust cap 64 that extends across the body portion 20 of the diaphragm 18 and encloses the voice coil former 52. Integration of the concave body 22 of the diaphragm 18 with the concave dust cap 62 in a locking action is advantageous as it increases the rigidity of the diaphragm to further inhibit diaphragm flex. This integration creates a piston action that is more effective, especially at high sound pressure levels (SPL).

The voice coil former 52 is telescopically received over the pole piece 66. The pole piece 66 preferably is tubular, the hollow center forming a pole piece vent 68. The vent 68 will enhance the speaker's compliance by relieving pressure from under the dust cap 64. Otherwise, this pressure might impede diaphragm movement at low frequencies and generate noise as air rushes through the voice coil gap. This is especially important in long throw drivers. A screen 69 may be placed over the vent hole to keep foreign material from entering the inner motor structure.

The transducer preferably comprises a back plate 70 in form of an annular ring. More preferably, the pole piece 66 and the back plate 70 are integrally formed in one piece of metal to improve magnetic field strength as well as heat transfer. It is advantageous to dye the back plate 70 and pole piece 66 black to increase heat transfer. In the preferred practice of this invention, the back plate 70 is formed with a "bumped" portion 72 to allow the voice coil former 52 maximum movement without ever contacting the back plate. The lower windings can be damaged and cause driver failure if contact occurs.

A permanent magnet 74 is supported between the back plate 70 and a top plate 76 A suitable magnet is a ceramic ferrite magnet. The magnet 74 should be optimized for the performance of each driver assembly 50. The size of the magnet does not always relate to the amount of bass produced. Too large of a magnet structure can over dampen and restrict diaphragm motion, reducing efficiency and low response characteristics.

The top plate 76 engages the lower surface of the rear end 78 of the basket 36. Thus, the pole piece 66, back plate 70, magnet 74 and top plate 76 are rigidly attached to the basket 36, while the voice coil former 52 and attached diaphragm 18 are supported in the basket for axial, reciprocal movement. A soft rubberized magnet boot 79 is desirable in many applications, as it will protect the magnet 74 from chipping and adds to the appearance of the driver assembly 50.

The annular surface 80 of the magnet 74 and the annular surface 82 of the top plate 76 are spaced radially from the voice coil 58 providing a gap 84. When the coil 58 is energized by a signal from the signal source 62, a magnetic field is created in the gap 84 between the voice coil former 52 and the magnet 74 causing the former and the diaphragm 18 linked to it to reciprocate axially and produce sound. The top plate 76 focuses the magnetic field in the gap 84. The top plate 76 may also be dyed black to improve heat transfer.

As shown in FIG. 2, the pole piece 66 preferably is extended above the top plate 76 to create a more uniform magnetic field to provide linear diaphragm travel. This reduces distortion caused by nonlinear movement. The longer pole also helps keep the voice coil cooler by not allowing the upper coil windings to radiate heat across to each other. This is desirable considering because heat buildup can cause speaker failure.

Now it will be appreciated that, in the ultra low frequency transducer of this invention, the size of the diaphragm and surround can be maximized to the size of the opening in the enclosure. This provides greater air displacement than the largest round diaphragm that would fit in the same enclosure. As a result, the diaphragm size and thus the displacement volume are increased as compared to conventional round diaphragm designs.

Changes can be made in the combination and arrangement of the various parts and elements described herein without departing from the spirit and scope of the invention as defined in the following claims.

What is claimed is:

1. An ultra low frequency transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, the surround being curved in normal cross section defining an arc, the surround having at least one pleat in each corner section, the pleat longitudinally defining an arc concentric to the arc of the surround, and wherein the straight side sections of the surround are substantially free of pleats.

2. The ultra low frequency transducer of claim 1 wherein the diaphragm is concave.

3. The ultra low frequency transducer of claim 2 wherein the diaphragm is rigid.

4. The ultra low frequency transducer of claim 3 wherein the diaphragm is integrally formed into trusses.

5. The ultra low frequency transducer of claim 1 wherein the diaphragm is integrally formed into trusses.

6. The ultra low frequency transducer of claim 1 wherein the surround is convex.

7. The ultra low frequency transducer of claim 6 wherein the at least one pleat in each corner section comprises a plurality of pleats.

8. The ultra low frequency transducer of claim 1 wherein the at least one pleat in each corner section comprises a plurality of pleats.

9. A loud speaker comprising:

an enclosure;

an ultra low frequency transducer supported in the enclosure, the transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, the surround being curved in normal cross section defining an arc, the surround having at least one pleat in each corner section, the pleat longitudinally defining an arc concentric to the arc of the surround, and wherein the straight side sections of the surround are substantially free of pleats.

10. The loud speaker of claim 9 wherein the diaphragm is concave.

11. The loud speaker of claim 10 wherein the diaphragm is rigid.

12. The loud speaker of claim 11 wherein the diaphragm is integrally formed into trusses.

13. The loud speaker of claim 9 wherein the diaphragm is integrally formed into trusses.

14. The loud speaker of claim 9 wherein the surround is convex.

15. The loud speaker of claim 14 wherein the at least one pleat in each corner section comprises a plurality of pleats.

16. The loud speaker of claim 9 wherein the at least one pleat in each corner section comprises a plurality of pleats.

17. An ultra low frequency transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, the surround being curved in normal cross section defining an arc, the surround having at least one pleat in each corner section, the pleat longitudinally defining an arc concentric to the arc of the surround, and wherein the surround is without circumferential pleats.

18. The ultra low frequency transducer of claim 17 wherein the diaphragm is concave.

19. The ultra low frequency transducer of claim 18 wherein the diaphragm is rigid.

20. The ultra low frequency transducer of claim 19 wherein the diaphragm is integrally formed into trusses.

21. The ultra low frequency transducer of claim 17 wherein the diaphragm is integrally formed into trusses.

22. The ultra low frequency transducer of claim 17 wherein the at least one pleat in each corner section comprises a plurality of pleats.

23. The ultra low frequency transducer of claim 17 wherein the surround is convex.

24. The ultra low frequency transducer of claim 23 wherein the diaphragm is concave.

25. The ultra low frequency transducer of claim 24 wherein the at least one pleat in each corner section comprises a plurality of pleats.

26. A loud speaker comprising:

an enclosure;

an ultra low frequency transducer supported in the enclosure, the transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, the surround being curved in normal cross section defining an arc, the surround having at least one pleat in each corner section, the pleat longitudinally defining an arc concentric to the arc of the surround, and wherein the surround is without circumferential pleats.

27. The loud speaker of claim 26 wherein the diaphragm is concave.

28. The loud speaker of claim 27 wherein the diaphragm is rigid.

29. The loud speaker of claim 28 wherein the diaphragm is integrally formed into trusses.

30. The loud speaker of claim 26 wherein the diaphragm is integrally formed into trusses.

31. The loud speaker of claim 26 wherein the at least one pleat in each corner section comprises a plurality of pleats.

32. The loud speaker of claim 26 wherein the surround is convex.

33. The loud speaker of claim 32 wherein the diaphragm is concave.

34. The loud speaker of claim 33 wherein the at least one pleat in each corner section comprises a plurality of pleats.

35. An ultra low frequency transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, each corner section of the surround forming an arc extending between the adjacent side sections, the surround having at least one pleat in each corner section, the length of the at least one pleat extending radially to the arc formed by the corner section, and wherein the side sections of the surround are substantially free of pleats.

36. The ultra low frequency transducer of claim 35 wherein the diaphragm is concave.

37. The ultra low frequency transducer of claim 36 wherein the diaphragm is rigid.

38. The ultra low frequency transducer of claim 37 wherein the diaphragm is integrally formed into trusses.

39. The ultra low frequency transducer of claim 35 wherein the diaphragm is integrally formed into trusses.

40. The ultra low frequency transducer of claim 35 wherein the at least one pleat in each corner section comprises a plurality of pleats.

41. The ultra low frequency transducer of claim 35 wherein the surround is convex.

42. The ultra low frequency transducer of claim 41 wherein the diaphragm is concave.

43. The ultra low frequency transducer of claim 42 wherein the at least one pleat in each corner section comprises a plurality of pleats.

44. A loud speaker comprising:

an enclosure;

an ultra low frequency transducer supported in the enclosure, the transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, each corner section of the surround forming an arc extending between the adjacent side sections, the surround having at least one pleat in each corner section, the length of the at least one pleat extending radially to the arc formed by the corner section, and wherein the side sections of the surround are substantially free of pleats.

45. The loud speaker of claim 44 wherein the diaphragm is concave.

46. The loud speaker of claim 45 wherein the diaphragm is rigid.

47. The loud speaker of claim 46 wherein the diaphragm is integrally formed into trusses.

48. The loud speaker of claim 44 wherein the diaphragm is integrally formed into trusses.

49. The loud speaker of claim 44 wherein the at least one pleat in each corner section comprises a plurality of pleats.

50. The loud speaker of claim 44 wherein the surround is convex.

51. The loud speaker of claim 50 wherein the diaphragm is concave.

52. The loud speaker of claim 51 wherein the at least one pleat in each corner section comprises a plurality of pleats.

53. An ultra low frequency transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, each corner section of the surround forming an arc extending between the adjacent side sections, the surround having at least one pleat in each corner section, the length of the at least one pleat extending radially to the arc formed by the corner section, and wherein the surround is without circumferential pleats.

54. The ultra low frequency transducer of claim 53 wherein the diaphragm is concave.

55. The ultra low frequency transducer of claim 54 wherein the diaphragm is rigid.

56. The ultra low frequency transducer of claim 55 wherein the diaphragm is integrally formed into trusses.

57. The ultra low frequency transducer of claim 53 wherein the diaphragm is integrally formed into trusses.

58. The ultra low frequency transducer of claim 53 wherein the at least one pleat in each corner section comprises a plurality of pleats.

59. The ultra low frequency transducer of claim 53 wherein the surround is convex.

60. The ultra low frequency transducer of claim 59 wherein the diaphragm is concave.

61. The ultra low frequency transducer of claim 60 wherein the at least one pleat in each corner section comprises a plurality of pleats.

62. A loud speaker comprising:

an enclosure;

an ultra low frequency transducer supported in the enclosure, the transducer comprising:

a basket having a square front opening;

a driver assembly supported by the basket comprising a permanent magnet and a reciprocally supported voice coil, the voice coil connectable to a signal source, whereby the driver assembly is adapted to convert signals from the signal source into long reciprocating axial motion of the voice coil;

a diaphragm with a square periphery and a center portion, the center portion being linked for movement with the voice coil to produce long excursions of the diaphragm; and a square flexible surround between the periphery of the diaphragm and the front opening of the basket, the surround comprising four straight side sections of equal length with four curved corner sections between adjacent side sections, the surround being curved in normal cross section defining an arc, the surround having at least one pleat in each corner section, the pleat longitudinally defining an arc concentric to the arc of the surround, and wherein the surround is without circumferential pleats.

63. The loud speaker of claim 62 wherein the diaphragm is concave.

64. The loud speaker of claim 63 wherein the diaphragm is rigid.

65. The loud speaker of claim 64 wherein the diaphragm is integrally formed into trusses.

66. The loud speaker of claim 62 wherein the diaphragm is integrally formed into trusses.

67. The loud speaker of claim 62 wherein the at least one pleat in each corner section comprises a plurality of pleats.

68. The loud speaker of claim 62 wherein the surround is convex.

69. The loud speakerr of claim 68 wherein the diaphragm is concave.

70. The loud speaker of claim 69 wherein the at least one pleat in each corner section comprises a plurality of pleats.

* * * * *

UNITED STATES PATENT AND TRADEMARK OFFICE

CERTIFICATE OF CORRECTION

PATENT NO. : 6,611,604 B1 
DATED : August 26, 2003
INVENTOR(S) : Steven M. Irby and William O. Doering It is certified that error appears in the above-identified patent and that said Letters Patent is hereby corrected as shown below:

Title page,
Item [56], References Cited, FOREIGN PATENT DOCUMENTS, should include the following references:

| | | |
|---|---|---|
| -- JP | 59-86992 | 5/1984 |
| JP | 61-158297 | 7/1986 |
| JP | 61-48298 | 3/1986 |
| JP | 60-12897 | 1/1985 |

OTHER REFERENCES, should list thereunder the following references:
-- Patent Abstract of Japan, Pat. No. JP59086992, EPO (1984)
Patent Abstract of Japan, Pat. No. JP60012897, EPO (1985)
Patent Abstract of Japan, Pat. No. JP61048298, EPO (1986)
Patent Abstract of Japan, Pat. No. JP61158297 EPO (1986). --

Signed and Sealed this

Twentieth Day of January, 2004

JON W. DUDAS
*Acting Director of the United States Patent and Trademark Office*